US008316586B2

(12) United States Patent
Ellingson

(10) Patent No.: US 8,316,586 B2
(45) Date of Patent: Nov. 27, 2012

(54) ARCHABLE FLASHING

(75) Inventor: Robert T. Ellingson, Social Circle, GA (US)

(73) Assignee: Astro Plastics, Inc., Covington, GA (US)

( * ) Notice: Subject to any disclaimer, the term of this patent is extended or adjusted under 35 U.S.C. 154(b) by 57 days.

(21) Appl. No.: 12/048,508

(22) Filed: Mar. 14, 2008

(65) Prior Publication Data

US 2009/0229193 A1 Sep. 17, 2009

(51) Int. Cl.
*E04D 13/14* (2006.01)

(52) U.S. Cl. ..... 52/58; 52/717.03

(58) Field of Classification Search ..... 52/58, 61, 52/62, 211, 287.1, 288.1, 716.2, 717.01, 52/717.03, 717.05

See application file for complete search history.

(56) References Cited

U.S. PATENT DOCUMENTS

| | | | | |
|---|---|---|---|---|
| 4,655,009 | A * | 4/1987 | DeGraan | 52/58 |
| 4,821,472 | A | 4/1989 | Tix | |
| 4,829,731 | A * | 5/1989 | Schluter | 52/287.1 |
| 5,115,605 | A | 5/1992 | Butler | |
| 5,119,609 | A | 6/1992 | Tait et al. | |
| 5,154,025 | A * | 10/1992 | Brown | 52/58 |
| 5,313,755 | A * | 5/1994 | Koenig, Jr. | 52/255 |
| 5,321,921 | A | 6/1994 | Holt | |
| 5,507,123 | A | 4/1996 | Holt | |
| 5,581,959 | A | 12/1996 | Occhipinti | |
| 5,671,583 | A * | 9/1997 | Turner | 52/745.16 |
| 5,735,035 | A | 4/1998 | Holt | |
| 6,041,550 | A | 3/2000 | Tix | |
| 6,119,416 | A | 9/2000 | Larson | |
| 6,119,420 | A * | 9/2000 | Koenig et al. | 52/255 |
| 6,931,799 | B2 * | 8/2005 | Webb | 52/167.1 |
| 7,392,625 | B2 * | 7/2008 | Bruggink et al. | 52/204.55 |
| 2005/0144865 | A1 * | 7/2005 | Ellingson | 52/272 |
| 2005/0204657 | A1 * | 9/2005 | Ellingson | 52/204.1 |
| 2005/0268569 | A1 | 12/2005 | Teodorovich | |
| 2006/0283101 | A1 * | 12/2006 | Sourlis | 52/58 |
| 2007/0157528 | A1 | 7/2007 | Gawoski | |
| 2008/0066403 | A1 * | 3/2008 | Koenig et al. | 52/255 |
| 2008/0196340 | A1 * | 8/2008 | Smythe | 52/287.1 |

OTHER PUBLICATIONS

SureSill, Ltd. Integrated Flashing System for Windows & Doors, advertising new product "HeadFlash-Flex", 2006, 5 pages.
Weather Out Flashing Products, 2005, 2 pages.

* cited by examiner

*Primary Examiner* — Christine T Cajilig
(74) *Attorney, Agent, or Firm* — Womble Carlyle Sandridge & Rice, LLP

(57) ABSTRACT

An archable flashing is disclosed for flashing around rectangular windows and doors and arch top windows and doors. The flashing has an elongated cap with an outside drip edge formed of a rigid plastic material. A flexible flange made of a flexible and stretchable plastic material is bonded to the inside edge of the cap and a rigid plastic nailing strip is bonded along the distal edge of the flexible flange. Spaced slits in the nailing strip subdivide it into segments and each segment is provided with one or more nail holes. The slits terminate at circular notches formed in the flexible flange adjacent to its junction with the nailing strip. The flashing is installed by placing its cap atop the straight or arched brick mold of a window or door while flexing the flange upwardly to rest against the adjacent wall. For arched brick mold, the flexible flange stretches differentially to accommodate the curve and the slits allow the nailing strip segments to separate. The flashing is then permanently installed by driving nails through the nail holes in the nailing strip segments and into the wall beneath.

12 Claims, 5 Drawing Sheets

ARCHABLE FLASHING

FIELD

The invention relates generally to doors and windows and more specifically to flashing.

BACKGROUND

Windows and doors typically are installed in rough openings of buildings and secured with fasteners, which sometimes are driven through peripheral nailing fins into the underlying framing. It is common to apply flashing strips around the exterior brick mould of the window or door frame to prevent water leakage. Flashing applied across the top or head mould of the door or window frame is sometimes referred to as head flashing or drip flashing. Drip flashing generally is L-shaped in cross-section and is installed atop the top brick mould with one leg overlying the upper edge of the brick mould and the other leg overlying, and often nailed and taped to, the adjacent wall surface. A continuous dam is thus formed where the top brick mould meets the wall to intercept and prevent the migration of water. It is common for drip flashing to be formed with a downturned lip referred to as a drip edge that slightly overlies the face of the head mould around its upper edge. The same flashing may be applied along the sides of the window or door to form a water barrier, although in these applications the drip edge generally is superfluous.

Applying flashing around square or rectangular windows and doors is straight forward. Elongated L-shaped flashing strips, which may be formed of sheet metal or plastic, are cut to length, nailed in place around the brick mould, and may be taped with flashing tape to prevent drafts. Increasingly, however, windows and doors are used that have an arched rather than a straight top. Applying flashing around an arched top presents a unique problem because traditional L-shaped flashing will not bend or arch around the curved brick mould without deforming. Notching the leg that lies against the wall to allow the structure to bend has been suggested, but such notches can breach the continuous dam otherwise formed and can degrade the reliability of the flashing. Special drip flashing made of flexible material and held in place with rigid brackets also has been suggested as has drip flashing with one corrugated or accordion-folded leg, but these also have not been satisfactory. As a consequence, many builders and installers order specially molded or formed curved drip flashing to fit the particular doors and windows being installed, which is expensive and troublesome.

A need therefore exists for a window and door flashing that can be installed easily around square or rectangular doors and windows and, just as easily and without special modification, around arch-topped windows and doors to form drip flashing. Such a flashing should retain a continuous uninterrupted dam where the arched brick mould meets the wall and should be easily installable without special brackets or other ancillary items. It also should be rollable for packaging and shipping so that it can be supplied in long bulk lengths.

SUMMARY

Briefly described, a window and door flashing has an elongated cap formed along its outside edge with a downturned lip defining a drip edge. The cap is made of semi-rigid plastic material such as rigid polyvinylchloride (PVC) that is flexible enough to be bent into an arch. Most preferably, an adhesive strip protected by a release layer is applied to the underside of the cap to aid in installation as detailed below. A flexible flap or flange is attached or bonded to the cap along its opposite edge and preferably the cap and the flexible flange are co-extruded together in a single extruding operation. The flange preferably is made of a flexible, stretchable, somewhat rubberized plastic material such as flexible PVC or an elastomer and is easily bendable along its length into an orientation that forms a right angle relative to the cap to which it is bonded. A nailing strip is bonded, again preferably by being co-extruded, along the distal edge of the flexible flange. The nailing strip is made of a rigid or semi-rigid plastic material such as PVC and is substantially narrower than the flange. Cut-out slots are formed at spaced intervals along the nailing strip to divide the strip into a plurality of co-extensive segments and each segment preferably has one or more nail holes formed therethrough for receiving a nail or other fastener. The slots have angled sides and terminate at a curved bottom in the flange just below the intersection of the flange and the nailing strip. As an alternative to slots, spaced apart transverse slits may be formed along the nailing strip to subdivide it into segments. Each transverse slit preferably terminates at a strain relief hole formed through the flexible flange just below the junction of the flange and the nailing strip.

The flashing of this invention may be used to flash along the head mould of standard rectangular doors and windows. In such an application, an appropriate length of flashing is cut from a bulk supply. The release layer is removed from the adhesive strip on the underside of the cap and the cap is positioned atop the brick mould with its drip edge extending slightly down over the face of the brick mold. In the process, the flexible flange is bent up to approximately 90 degrees relative to the cap until it lies flat against the wall surrounding the window or door. When properly positioned, the cap is pressed down to tack it in place with the adhesive strip. The flange can then be secured in position by driving nails through the nail holes in the nailing strip and into the wall. The flexible flange thus forms a continuous impervious dam along the intersection of the brick mould and wall. The flashing also may be applied along the sides of the window or door in the same way if desired. Façade, such as brick or clapboards, can then be applied atop the flange in the usual way.

While the flashing of this invention works very well with rectangular doors and windows, it is particularly useful in forming drip flashing along the top of an arched door or window. In such installations, an appropriate length of flashing is cut from a bulk supply to extend around the arch. The release layer is removed from the adhesive strip and the cap is progressively curved and applied around the arch. In the process, the flexible flange is bent up to lie against the surrounding wall. Since the flexible flange is made of a flexible, stretchable, somewhat rubberized material, its outer perimeter stretches to accommodate the curve of the arch. At the same time, the segments of the nailing strip, which are not easily bendable, separate at their slots or slits to accommodate the stretching flange. The flange can then be secured in position by driving nails through the nail holes of the nailing strip segments and fçcade can be applied in the usual way around the top of the window. As with a rectangular window or door, the flange forms a continuous impervious dam at the junction of the curved brick mould and the wall.

The invention will be better understood and appreciated upon review of the detailed description set forth below in conjunction with the accompanying drawing figures, which are briefly described as follows.

DETAILED DESCRIPTION

Figure 1:
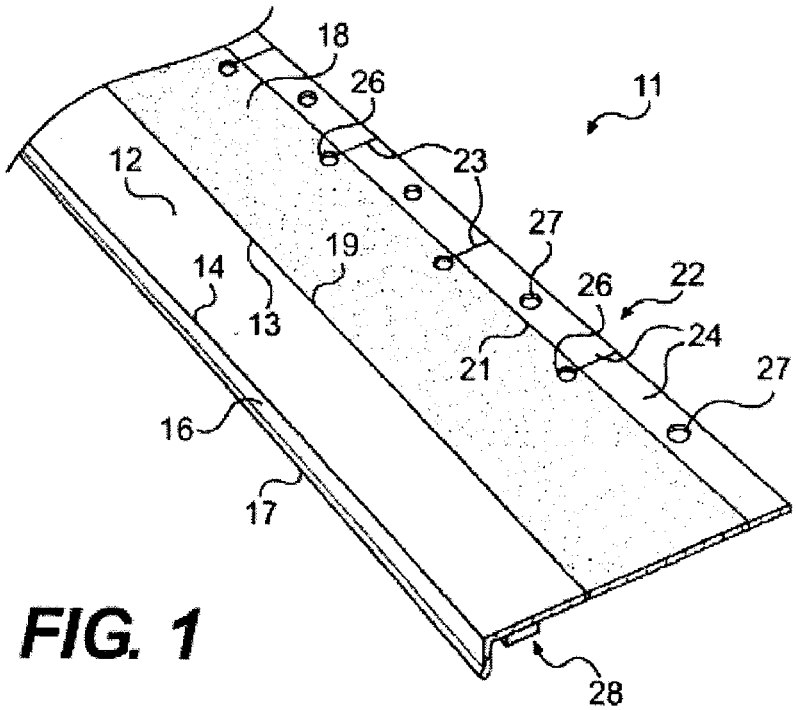
FIG. 1 is a perspective view of a short section of an archable flashing that embodies principles of the invention in one form.

Referring now in more detail to the drawings, in which like reference numerals refer to like parts throughout the several views, FIG. 1 illustrates a short length of archable flashing 11 that embodies principles of the invention in one preferred form. The archable flashing 11 comprises a cap 12 having an inside edge 13 and an outside edge 14. A downturned lip depends from the outside edge 14 of the cap 12 and terminates in a slightly outturned drip edge 17. The cap 12, lip 16, and drip edge 17 preferably are formed of a rigid or semi-rigid plastic material such as, for example, rigid PVC or any other suitable weatherable rigid or simi-rigid plastic material. These components also preferably are formed as a unitary structure in a plastics extrusion process. In fact, the entire archable flashing most preferably is formed as a unitary structure in a plastics co-extrusion process such that the various components are bonded together at their junctions.

An elongated flexible flap or flange 18 is bonded along one edge 19 to the inside edge of the cap 12 and extends rearwardly from the cap 12 to a distal edge 21. The flexible flange 18 may be formed of any appropriate flexible or rubberized plastic or polymer material such as flexible PVC or any other flexible elastomer. The properties of the selected material should be such that it can be co-extruded with and bond to the other components of the flashing and is sufficiently flexible to be flexed upwardly and positioned at an angle of approximately ninety degrees relative to the cap 12. Further, the material of the flange should be stretchable along its length. In FIG. 1, the flexible flange 18 is shown bonded directly to the inside edge of the cap 12; however, as discussed below, it may be extruded so that it partially overlaps the cap 12 to form a better bond and to reduce the likelihood of a tear at the juncture that might result in leakage.

Figure 3:
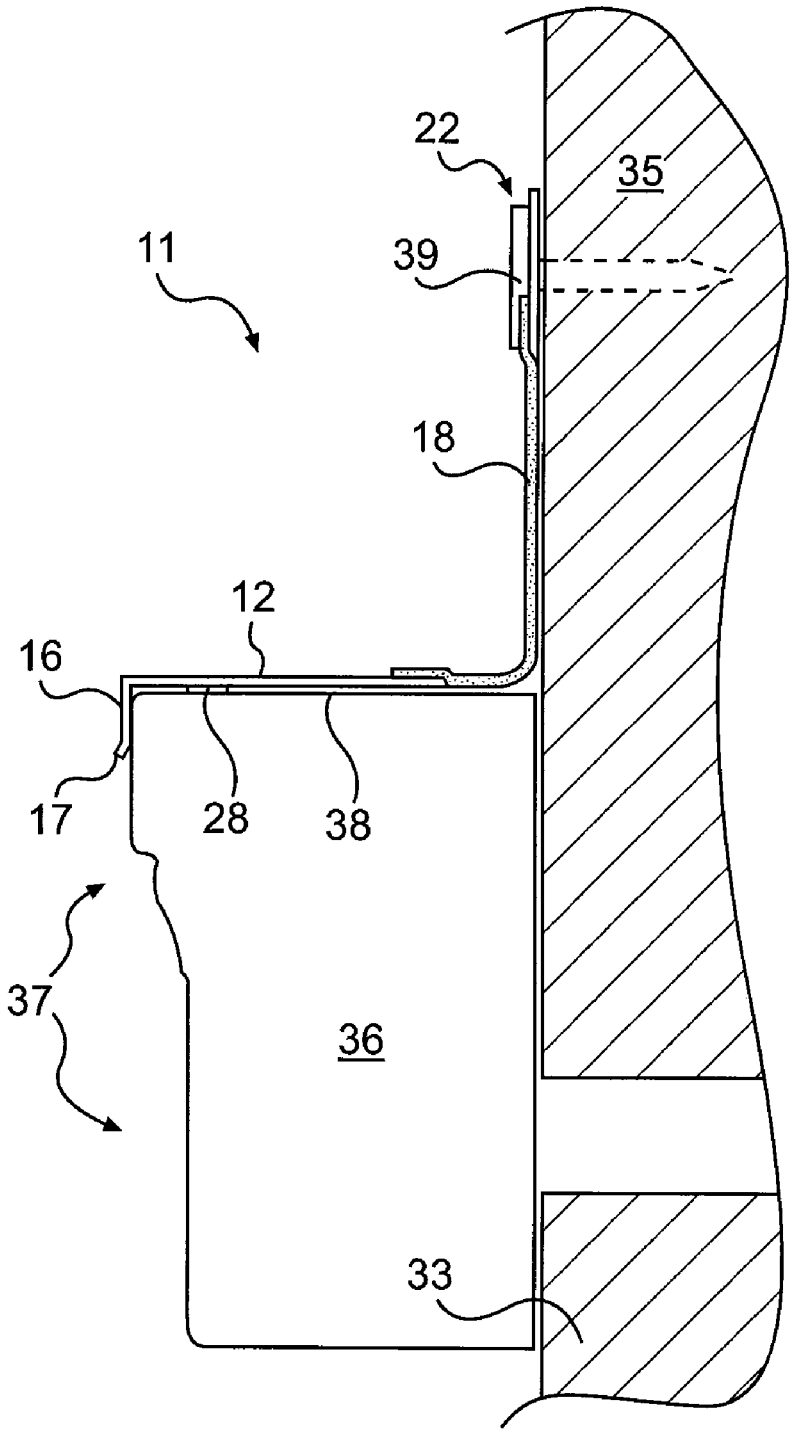
FIG. 3 is a cross sectional view showing the archable flashing installed along the top of a rectangular window or door.

An elongated nailing strip 22 is bonded to the distal edge 21 of the flexible flange 18 and extends slightly rearwardly therefrom. As with the cap 12, the nailing strip 22 preferably is formed of a rigid or semi-rigid plastic material such as rigid PVC and, again, is co-extruded with the other components of the flashing in a single co-extrusion process. The nailing strip can be bonded directly to the edge of the flexible flange as shown in FIG. 1 or, alternatively, can be extruded so that the flexible flange slightly overlaps the nailing flange as shown in FIG. 3. A series of spaced apart transverse slits 23 are formed along the length of the nailing strip and these slits subdivide the nailing strip 22 into an array of individual nailing segments 24. The segments may be from about one inch to about 8 inches in length but most preferably are about 4 inches in length for purposes described in more detail below. Each of the slits 23 terminates at a circular hole or strain relief hole 26 formed through the flexible flange 18 adjacent to its junction with the nailing strip 22. Further, each segment of the nailing strip 22 is formed with a nail hole 27 preferably located at about the midpoint of the segment. Alternatively, two or more spaced nail holes may be formed at any positions along the segments or the segments may be provided with no nail holes at all.

A strip of adhesive material 28 may be provided on the bottom surface of the cap 12 if desired, although it is not required and may be omitted. Preferably, the strip 28 is a length of double sided adhesive tape such as double sided rubber based adhesive tape available from the Duraco company of Forest Park, Ill. or VHB tape available from the 3M Corporation of Minneapolis, Minn. The strip 28 also preferably is provided with a release layer 29 (FIG. 4) for purposes described in more detail below. Other adhesives may be substituted for the strip 28 as desired.

Figure 2:
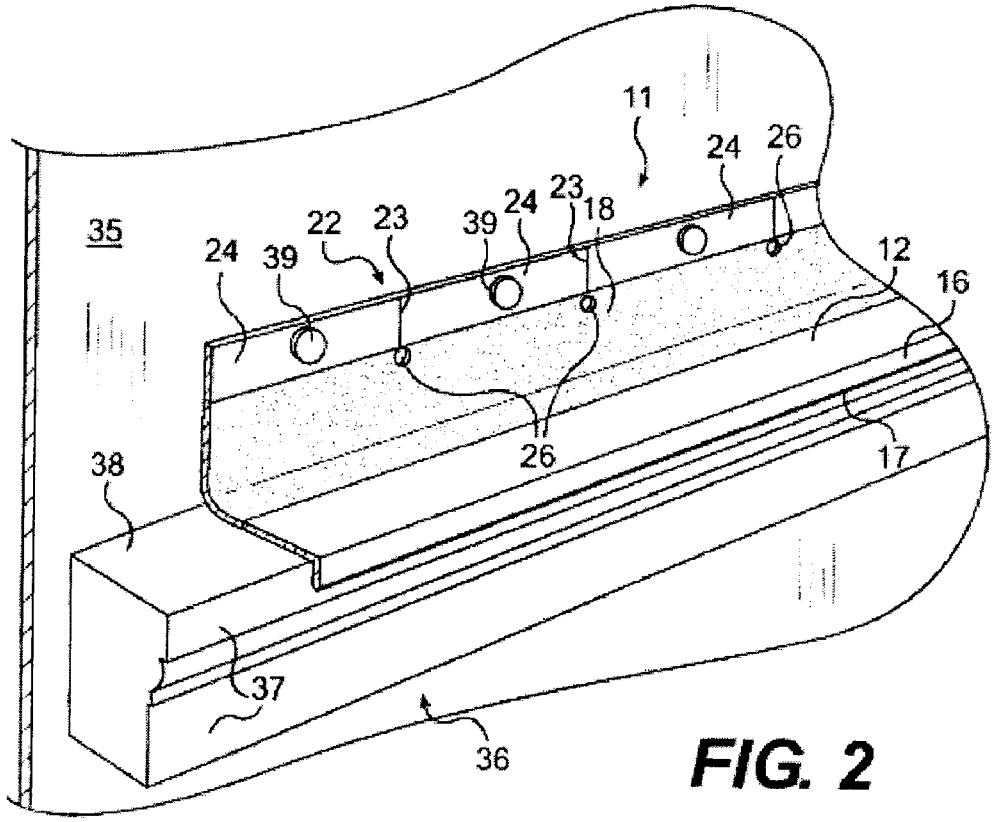
FIG. 2 is a perspective view of a length of the archable flashing of FIG. 1 installed along the top of a rectangular window or door.

FIG. 2 illustrates the archable flashing of this invention installed along the top of a rectangular window or door. The window or door is framed on the outside with brick mould 36 that extends around the sides and top of the window or door and a sill (not shown) spans the bottom of the window or door, all as is commonly known to those of skill in the art. The archable flashing 11 is shown installed along the top of the window or door in FIG. 2, although it also can be installed along the sides of the window or door in the same way. While the flashing is described below in the context of installation along the top of a window or door, it will be understood that installation along the sides is essentially the same.

Referring to FIG. 2, the brick mould 36 is a decorative exterior moulding that has a front face 37 and a top surface 38 and is positioned against the wall 35 surrounding the rough opening in which the window or door is installed. Traditionally, façade such as brick, clapboards, stucco, or the like is installed on the wall abutting the brick mold. Since the abutment of the façade does not generally create a water tight junction, it is necessary to provide flashing, as is known in the art, that prevents water from seeping behind the brick façade and brick mould and that directs water off of the top of the brick mould to prevent rotting and deterioration. The flashing 11 of this invention is installed for this purpose.

Figure 4:
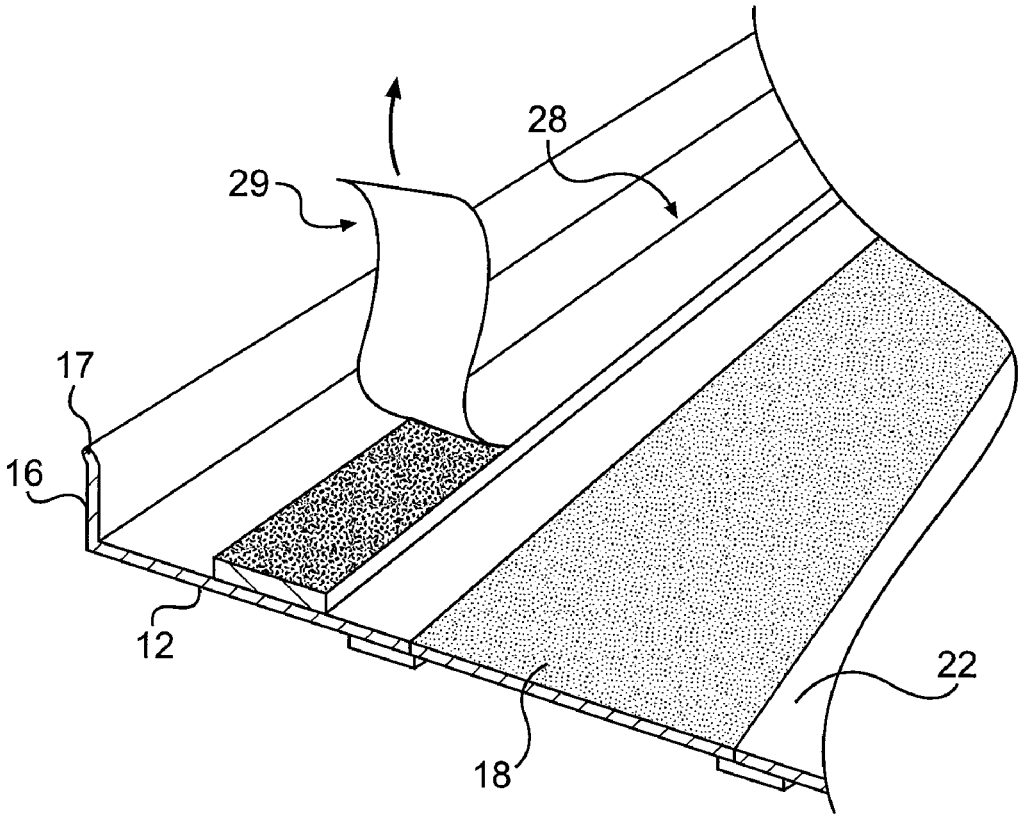
FIG. 4 is a perspective view of the underside of the archable flashing of FIG. 1 showing a strip of tape with release layer.

First, a length of flashing corresponding to the length of the brick mould is cut from a bulk supply and the release layer is peeled off of the adhesive strip as illustrated in FIG. 4. The cap 12 is then position atop the brick mould with its downturned lip and drip edge slightly overlapping the front face 37 of the brick mould as illustrated. At the same time, the flexible flange 18 is flexed upwardly until at least a part of it and the nailing strip are disposed against the wall 35 at a substantially right angle to the cap 12. Fine adjustments can then be made if necessary and the cap pressed down against the top surface 38 of the brick mould to tack it in place with the adhesive strip. The flashing can then be permanently attached by driving nails 39 or other appropriate fasteners through the nail holes in the segments 24 and into the wall beneath. When in place, the flashing, and particularly the flexible flange, forms a water impervious dam at the juncture of the brick mould and the wall. Further, the cap 12, and perhaps a portion of the flexible flange 18, cover the top surface 38 of the brick mould to prevent standing water atop the brick mould and to direct water away from the wall. As water is directed away, it flows down the downturned lip 16 and drips harmlessly off of the drip edge. Façade may then be installed on the wall overlapping and abutting the flashing, as is common in the art.

FIG. 3 is a cross-sectional view of the flashing installed along the top of a window or door as just described. As is perhaps more apparent in this figure, the flashing 11 is installed with its cap 12 and a relatively short portion of the flexible flange 18 overlying the top surface 38 of the brick mould 36 and with the lip 16 and drip edge 17 slightly overlapping the front face 37 of the brick mould. The flexible flange 18 is flexed upwardly at an angle of about ninety degrees and lies against the wall 35 adjacent the brick mould forming a water impervious dam along the juncture of the brick mould and the wall. The flashing is tacked in place with the adhesive strip 28 and permanently affixed with nails 39 driven through the nailing strip and into the wall beneath. Preferably, the width of the cap 12 is less than the thinnest standard brick mould used in construction. In this way, the flashing of this invention accommodates a variety of brick mould thicknesses with more of the flexible flange overlying the top of thicker brick mould and less overlying the top of thinner brick mould. The head jamb 33 of the window or door is illustrated in a traditional location in FIG. 3 for clarity.

FIG. 4 illustrates a preferred method of tacking the flashing in place during installation until it can be permanently affixed with nails. Specifically, as mentioned above, a strip of double sided adhesive is applied along the bottom of the cap with its exposed side being protected by a release layer. When the proper length of flashing has been cut, dry fitted, and is ready to be installed, the release layer is peeled away to expose the adhesive surface beneath and the flashing is positioned and pressed down, whereupon the adhesive strip sticks to the top surface of the brick mould to tack the flashing in place. The tacking of the flashing in place has been found desirable to prevent the resiliency of the flexible flange from pushing the cap and drip edge forward before the flashing can be nailed in place. However, an adhesive strip is only one exemplary technique and others, such as applying a quick setting adhesive, hot glue, or silicone sealant to the bottom of the cap, or any other appropriate technique may be used. In fact, while less desirable, the flashing may be installed with no tacking at all.

The flashing of this invention functions as well or better than standard flashing when installed on rectangular windows and doors as detailed above. However, its primary advantage is its ability to be installed just as easily and effectively around the curved brick mould of arched windows and doors, as illustrated in FIG. 5.

Figure 5:
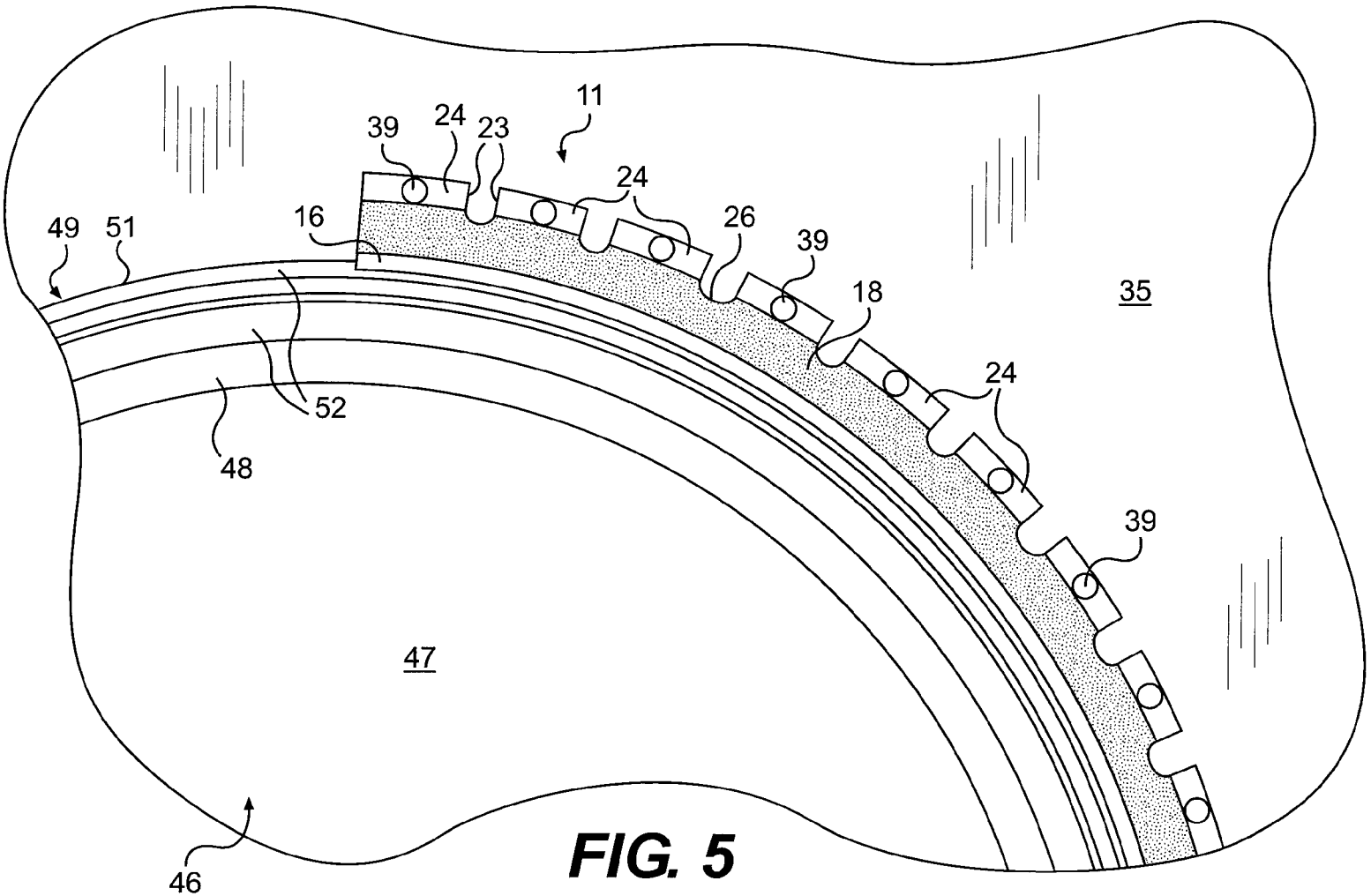
FIG. 5 is a front plan view showing the archable flashing installed along the top of an arched window or door.

FIG. 5 shows a section of an arch top window 46 having a window pane 47 bordered by a curved frame 48. The window 46 is installed in an appropriately sized and configured rough opening in a wall 35 and curved or arched brick mould 49 resides against the wall in the traditional way. Just as with the straight brick mould 36, the arched brick mould 49 has a front face 52 and a top surface 51, which defines the outer perimeter of the arch. Archable flashing is installed according to the invention around the arched brick mould 49 to prevent migration of water between the brick mould and the wall 35. While the flashing is illustrated extending only part way around the arch in FIG. 5 for clarity of description, it will be understood that, in reality, it is installed extending continuously around the arch.

Installation of the archable flashing of this invention around the arch top window is similar in respects to its installation atop a straight top window or door, with a few distinctions. A sufficient length of flashing is cut from a bulk supply to extend continuously around the arched brick mould. The release layer is then peeled off of the adhesive strip and the flashing is installed progressively around the arched brick mould, either from one end, from the middle, or otherwise. More specifically, from a starting place, the flashing is positioned against the outer surface of the brick mould with its cap and part of the flexible flange overlying the brick mold, the drip edge overhanging slightly the front face of the brick mould, and with the flexible flange and nailing strip positioned against the wall. The installer then works away from the starting point arching the flashing around the brick mould, tacking it progressively in place with the adhesive strip, and securing it permanently with nails. The rigid or semi-rigid material of the cap and drip edge is sufficiently flexible to allow it to be arced with little difficulty. At the same time, the rubber-like flexible material of the flange stretches along its outside extremities to accommodate the slightly larger arch around which it must extend at that location. This stretching causes the individual segments 24 of the nailing strip to spread apart at the slits as shown with the strain relief holes 26 also stretching out to prevent the spreading segments from tearing the adjacent portions of the flexible flange. The rigidity of the nailing strip segments also performs an important function in holding the outer extremities of the flexible flange flat against the wall and preventing the flange from deforming as it is differentially stretched across its width.

Figure 6:
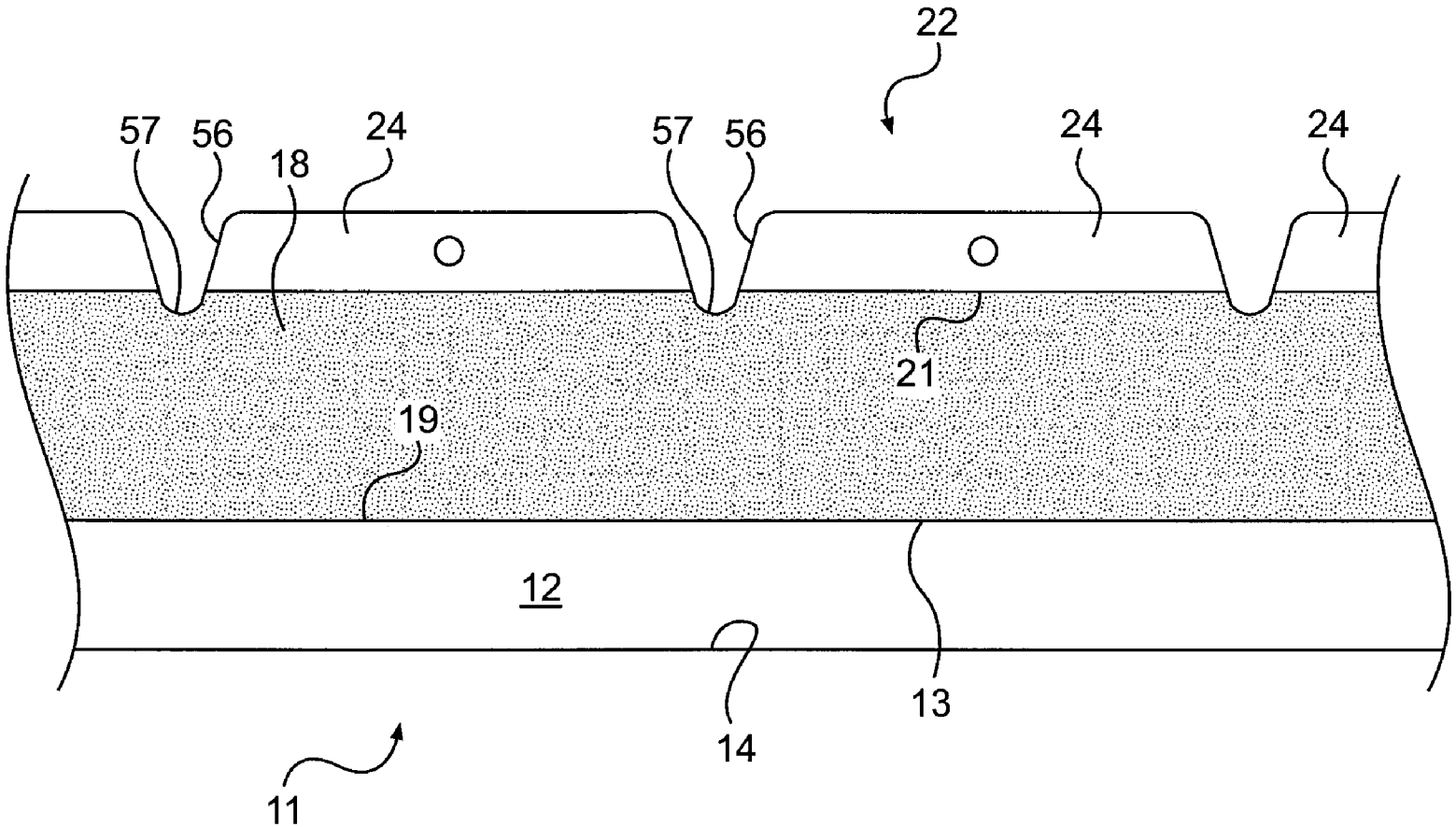
FIG. 6 is a top plan view of a length of archable flashing according to the invention with cut-out notches rather than slits and strain relief holes separating the nailing strip into segments.

As an alternative to the slits and strain relief holes shown in FIGS. 1 through 5, the archable flashing of the invention may be formed with spaced apart cut-out slots as illustrated in FIG. 6, which have been found advantageous for automated fabrication of the flashing. The archable flashing of FIG. 6 is similar in most respects to that of FIGS. 1 through 5 in that it has a cap 12 with an inside edge 13 and an outside edge 14 having a downturned lip and drip edge (not visible). Flexible flange 18 is bonded along the inside edge 13 of the cap 12 and extends to a distal edge 21. Nailing strip 22 is bonded to the distal edge 21 of the flexible flange. However, rather than slits and strain relief holes, an array of spaced apart slots 56 are formed along the nailing strip and subdivide the nailing strip into segments 24. The slots have angled sides that preferably form an angle of about 30 degrees with each other, but may form any angle between about zero and 60 degrees. Each notch terminates in a rounded bottom 57 in the flexible flange just below its intersection with the nailing strip and the bottom provides strain relief similar to the strain relief holes 26 of the embodiment of FIGS. 1 through 5.

When or as the flashing is positioned and tacked around the arch as described, it may be secured permanently with nails 39 or other fasteners driven through the segments of the nailing flange and into the wall beneath. When so installed, the flashing, again, forms a water impervious dam that prevents water from seeping between the brick mould and the wall. Façade can then be installed in the traditional way overlapping the flexible flange and nailing fin segments. It can thus be seen that the archable flashing functions equally well with, and is installed in the same manner, both on rectangular windows and doors and arch top windows and doors. A builder need not, then, order expensive custom flashing but can use the very same flashing for all window and door flashing applications, including along the sides of windows and doors.

It has been found advisable when extruding the archable flashing of this invention to extrude it in a single co-extrusion process so that flashing is one unitary member. Further, it may be desirable to extrude the flashing with a slight natural inward curve or bow. This has been found to facilitate better the bending of the flashing around arch top windows and doors and minimizes the chances that the downturned lip and drip edge will crumple, particularly when being bent around smaller arches. In addition, forming the flashing with a slight natural curve allows it to be rolled better into compact bulk rolls, which is more efficient for shipping, storage, and distribution.

The invention has been described herein in terms of preferred embodiments and methodologies considered by the inventor to represent the best mode of carrying out the invention. However, the illustrated embodiments are but mere examples. Many additions, deletions, and modifications might be made to these embodiments without departing from the spirit and scope of the invention, which, of course, is defined by the claims.

What is claimed is:

1. Archable flashing comprising:

an elongate, planar cap having an inside edge and being formed of a relatively rigid material;

an elongate flange having an outside edge bonded to the inside edge of the elongated cap and a distal edge, the flange being formed of a relatively flexible material;

an elongate nailing strip having an edge bonded at a junction to the distal edge of the flange and being formed of a relatively rigid material;

the elongate nailing strip being subdivided by a plurality of spaced apart transverse slits into a plurality of substantially coextensive abutting segments;

a plurality of strain relief holes formed through the elongate flange below the junction of the elongate flange and the nailing strip;

at least some of the spaced apart transverse slits terminating at a corresponding strain relief hole below the junction of the flange and the nailing strip;

the strain relief holes stretching when the segments of the nailing strip are spread apart to prevent the spreading segments from tearing the adjacent portions of the flange;

the flashing being bendable along the flange into a configuration having a generally L-shaped cross-section and archable along the length of the flashing to conform to an outer periphery of a molding surrounding a window or a door.

2. The archable flashing of claim 1 and wherein the relatively rigid material is a plastic material.

3. The archable flashing of claim 2 and wherein the plastic material comprises a weatherable rigid polymer.

4. The archable flashing of claim 3 and wherein the weatherable rigid polymer comprises rigid PVC.

5. The archable flashing of claim 1 and wherein the relative flexible material is a plastic material.

6. The archable flashing of claim 1 and wherein the relatively flexible material comprises an elastomer.

7. The archable flashing of claim 1 and wherein the relatively flexible material comprises flexible PVC.

8. The archable flashing of claim 1 and wherein the cap, the flange, and the nailing strip are co-extruded as a unitary structure.

9. The archable flashing of claim 1 and further comprising a downturned drip edge formed along the outside edge of the cap.

10. The archable flashing of claim 1 and wherein the elongate flange is lengthwise stretchable a greater amount along its distal edge than along its outside edge to permit the flashing to be curved around an arch top window or door, the strain relief holes stretching when the flange is so stretched to facilitate separation of the segments of the nailing flange and to prevent tearing of the flange.

11. The archable flashing of claim 1 and further comprising nail holes formed in the segments of the nailing strip.

12. The archable flashing of claim 1 and further comprising a strip of adhesive extending along an underside of the cap for tacking the flashing in place during installation.

* * * * *